US009399935B2

(12) United States Patent
Inoue et al.

(10) Patent No.: US 9,399,935 B2
(45) Date of Patent: Jul. 26, 2016

(54) OIL PAN INNER TANK VALVE STRUCTURE

(75) Inventors: Tomonari Inoue, Ogaki (JP); Tsutomu Okuda, Gifu (JP); Yoshifumi Taga, Fuwa-gun (JP); Hiroyuki Sato, Ibi-gun (JP); Kazuya Yoshijima, Okazaki (JP); Atsushi Konno, Kariya (JP)

(73) Assignees: PACIFIC INDUSTRIAL CO., LTD., Ogaki-shi (JP); TOYOTA JIDOSHA KABUSHIKI KAISHA, Toyota (JP); KABUSHIKI KAISHA TOYOTA JIDOSHOKKI, Kariya-shi (JP)

( * ) Notice: Subject to any disclaimer, the term of this patent is extended or adjusted under 35 U.S.C. 154(b) by 311 days.

(21) Appl. No.: 13/811,431

(22) PCT Filed: Sep. 9, 2011

(86) PCT No.: PCT/IB2011/002311

§ 371 (c)(1),
(2), (4) Date: Jan. 22, 2013

(87) PCT Pub. No.: WO2012/035426

PCT Pub. Date: Mar. 22, 2012

(65) Prior Publication Data

US 2013/0126016 A1 May 23, 2013

(30) Foreign Application Priority Data

Sep. 15, 2010 (JP) ..... 2010-206700

(51) Int. Cl.
*F16N 31/00* (2006.01)
*F16K 31/18* (2006.01)
(Continued)

(52) U.S. Cl.
CPC ..... *F01M 11/00* (2013.01); *F01M 11/0004* (2013.01); *F01M 11/0408* (2013.01); *F01M 2011/0045* (2013.01); *Y10T 137/7358* (2015.04)

(58) Field of Classification Search
CPC ..... F16K 21/18; F16K 31/18; F16K 31/22; F16K 33/00; F16K 24/042; F16K 24/044; F01M 5/021; F01M 2005/023; F01M 2011/0045; F01M 2001/037; F01M 2001/0041; F01M 11/0408
USPC ..... 137/409, 411, 429, 430, 433, 101.27, 137/431, 436, 43; 184/106
See application file for complete search history.

(56) References Cited

U.S. PATENT DOCUMENTS 237,066 A * 1/1881 Textor ..... E03F 5/042 137/433
843,069 A * 2/1907 Burdick ..... 137/433
(Continued)

FOREIGN PATENT DOCUMENTS

CN 101415914 A 4/2009
CN 101575995 A 11/2009
(Continued)

OTHER PUBLICATIONS

Jul. 26, 2012 Partial Translation of Office Action issued in Japanese Patent Application No. 2010-206700.
(Continued)

*Primary Examiner* — Kevin Murphy
*Assistant Examiner* — Hailey K Do
(74) *Attorney, Agent, or Firm* — Oliff PLC

(57) ABSTRACT

In an oil pan inner tank valve structure, a disc-shaped float valve is arranged below a valve port that provides fluid communication between the inside and outside of a bottom wall of an inner tank, and a lower cover is arranged below the float valve. In addition, a center recess is depressed at a lower surface center of the float valve, and a lateral movement restricting pin is upright from the lower cover and is constantly engaged with the center recess by recess/protrusion engagement. The lower cover restricts a vertically movable range of the float valve. In addition, the lateral movement restricting pin restricts lateral movement of the float valve so that a top portion of an upper surface bulged portion vertically constantly faces an area inside a valve seat.

13 Claims, 11 Drawing Sheets

(51) Int. Cl.
*F01M 11/00* (2006.01)
*F01M 11/04* (2006.01)

(56) References Cited

U.S. PATENT DOCUMENTS

| | | | | |
|---|---|---|---|---|
| 1,423,679 | A * | 7/1922 | Pavitchich | E03F 5/046 137/433 |
| 2,130,876 | A * | 9/1938 | Cordts | 141/202 |
| 3,590,955 | A * | 7/1971 | Rau | 184/6 |
| 3,768,505 | A * | 10/1973 | Benke | 137/433 |
| 2004/0211465 | A1 * | 10/2004 | Miyoshi | F16K 24/044 137/202 |
| 2008/0210491 | A1 | 9/2008 | Mori et al. | |
| 2009/0014248 | A1 | 1/2009 | Yamashita et al. | |

FOREIGN PATENT DOCUMENTS

| | | | |
|---|---|---|---|
| DE | 39 25 411 | A1 | 2/1991 |
| EP | 1 806 483 | A1 | 7/2007 |
| JP | 58-062112 | U1 | 4/1983 |
| JP | U-58-113810 | | 8/1983 |
| JP | 04-024610 | U1 | 2/1992 |
| JP | A-2003-222012 | | 8/2003 |
| JP | A-2005-48695 | | 2/2005 |
| JP | A-2006-336580 | | 12/2006 |
| JP | A-2007-138792 | | 6/2007 |
| JP | 2009085158 | A * | 4/2009 |
| JP | B2-4420026 | | 2/2010 |
| JP | 2010-121486 | A | 6/2010 |

OTHER PUBLICATIONS

Partial Translation of Jul. 21, 2014 Office Action issued in Chinese Patent Application No. 201180044031.1.

Partial Translation of Dec. 22, 2014 Office Action issued in German Patent Application No. 112011102153.4.

* cited by examiner

OIL PAN INNER TANK VALVE STRUCTURE

BACKGROUND OF THE INVENTION

1. Field of the Invention

The invention relates to an oil pan inner tank valve structure that is able to close a valve port, formed at the bottom wall of an inner tank of a double-tank oil pan, with a float valve arranged below the valve port.

2. Description of Related Art

As a float valve provided for an existing oil pan inner tank valve structure of this type, there is known a structure that a valve element arranged below a valve port and a floating element arranged above the valve port are coupled to each other by a valve shaft that extends through the valve port (for example, see Japanese Patent No. 4420026 (from line 43 in the paragraph 18 to line 9 in the paragraph 19, FIG. 5)). The float valve is configured so that the floating element moves upward or downward in accordance with an oil surface in the inner tank to cause the valve element to open or close the valve port.

Incidentally, in the above described existing oil pan inner tank valve structure, there is a problem that the floating element, the valve shaft and the valve element are arranged in the vertical direction and, therefore, the size of the structure increases. In addition, there is another problem that the float valve is inclined because of flow of oil in the inner tank during operation of an engine, inclination of an oil surface during running on a ramp, or the like, and then the valve shaft is caught inside the valve port to cause abnormal valve opening.

SUMMARY OF THE INVENTION

The invention provides an oil pan inner tank valve structure that is able to prevent abnormal valve opening and that may be reduced in size.

A first aspect of the invention relates to an oil pan inner tank valve structure in a double-tank oil pan having an inner tank inside an outer tank. The oil pan inner tank valve structure includes: a valve port that is formed in a bottom wall of the inner tank; a float valve that is arranged below the valve port and that separates or moves away from a valve seat around the valve port depending on whether there is buoyancy of oil inside the double-tank oil pan to open or close the valve port, that has an upper surface mound portion gradually bulging or protruding upward from an outer peripheral portion of an upper surface of the float valve, and that closes the valve port in such a manner that the upper surface mound portion contacts the valve seat; a vertical movement restricting portion that faces a lower surface of the float valve and that restricts a vertically movable range of the float valve; and a lateral movement restricting portion that is provided for any one of the inner tank and the outer tank, and that restricts lateral movement of the float valve so that a top portion of the upper surface mound portion constantly vertically faces an area inside the valve seat.

In the oil pan inner tank valve structure, the upper surface mound portion may have a contact portion that contacts the valve seat, and at least a surface of the contact portion may have a spherical shape.

In the oil pan inner tank valve structure, the valve seat may surround the valve port of the bottom wall and may bulge its annular area downward.

In the oil pan inner tank valve structure, a plurality of the valve ports may be provided inside the valve seat.

In the oil pan inner tank valve structure, a center recess may be provided at one of a lower surface center and upper surface center of the float valve, the lateral movement restricting portion may be a lateral movement restricting pin that is received by the center recess, and a center protruding portion that protrudes in a direction in which the center recess is depressed may be provided at the other one of the lower surface center and upper surface center of the float valve.

In the oil pan inner tank valve structure, a center recess may be provided at a lower surface center of the float valve, the float valve may have a center protruding portion and a contact portion that contacts the valve seat, the center protruding portion protruding upward at an upper surface center thereof at an inclination steeper than that of the contact portion, the vertical movement restricting portion may cover the center recess from a lower side, and the lateral movement restricting portion may be a lateral movement restricting pin that protrudes from the vertical movement restricting portion and that is received by the center recess.

In the oil pan inner tank valve structure, the vertical movement restricting portion may be a bulged wall that bulges downward from a lateral position with respect to the valve seat on a lower surface of the bottom wall of the inner tank and that has an oil passing hole that allows the oil to pass therethrough, and the float valve may be accommodated in a valve accommodating room between the bottom wall and the bulged wall.

According to the first aspect of the invention, the vertical movement restricting portion and the lateral movement restricting portion are provided to cause the float valve to function as a valve element and a floating element to thereby make it possible to reduce the size in the vertical direction. By so doing, the float valve is arranged at the lower side to make it possible to suppress the influence of inclination of an oil surface or flow of inner tank oil. In addition, an existing valve shaft may be omitted. By so doing, it is possible to prevent abnormal valve opening of the float valve. Furthermore, the upper surface mound portion that gradually bulges upward from the outer peripheral portion toward the center portion or that gradually protrudes upward from the outer peripheral portion toward the center portion is formed on the upper surface of the float valve, so the valve port may be closed irrespective of the inclination of the float valve. That is, a valve closed state is stable.

Even when the float valve is inclined in any one of the longitudinal and transverse directions of the vehicle, it is possible to close the valve by bringing the float valve into contact with the entire valve seat. That is, a valve closed state is further stable.

The valve seat according to the first aspect of the invention may be formed so that an annular area surrounding the valve port is bulged downward. With such a structure, the valve seat may be formed by pressing, so time and effort for machining are reduced in comparison with the case where the opening edge of the valve port is chamfered to form the valve seat. In addition, the surface of the valve seat bulged by pressing is smooth, so it is possible to prevent the valve seat and the float valve from being caught by each other.

Even if the valve port is exposed from the oil surface, part of the upper surface of the float valve may be covered with a wall portion formed between the plurality of valve ports, so return oil flowing from the engine is hard to collide with the float valve.

The center protruding portion is provided at a surface on the opposite side of the surface of the float valve, on which the center recess is provided, to thereby make it possible to balance the thickness, so, when the float valve is molded by resin, molding sink is reduced to thereby make it possible to stabilize the surface shape of the upper surface mound portion.

Bubbles stagnate inside the center recess provided on the lower surface of the float valve, and the float valve may be raised by the buoyancy of oil and the buoyancy of bubbles.

It is possible to allow the float valve to be vertically movable in the valve accommodating room between the bottom wall of the inner tank and the bulged wall bulged downward from the bottom wall.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

First Embodiment

Figure 1:
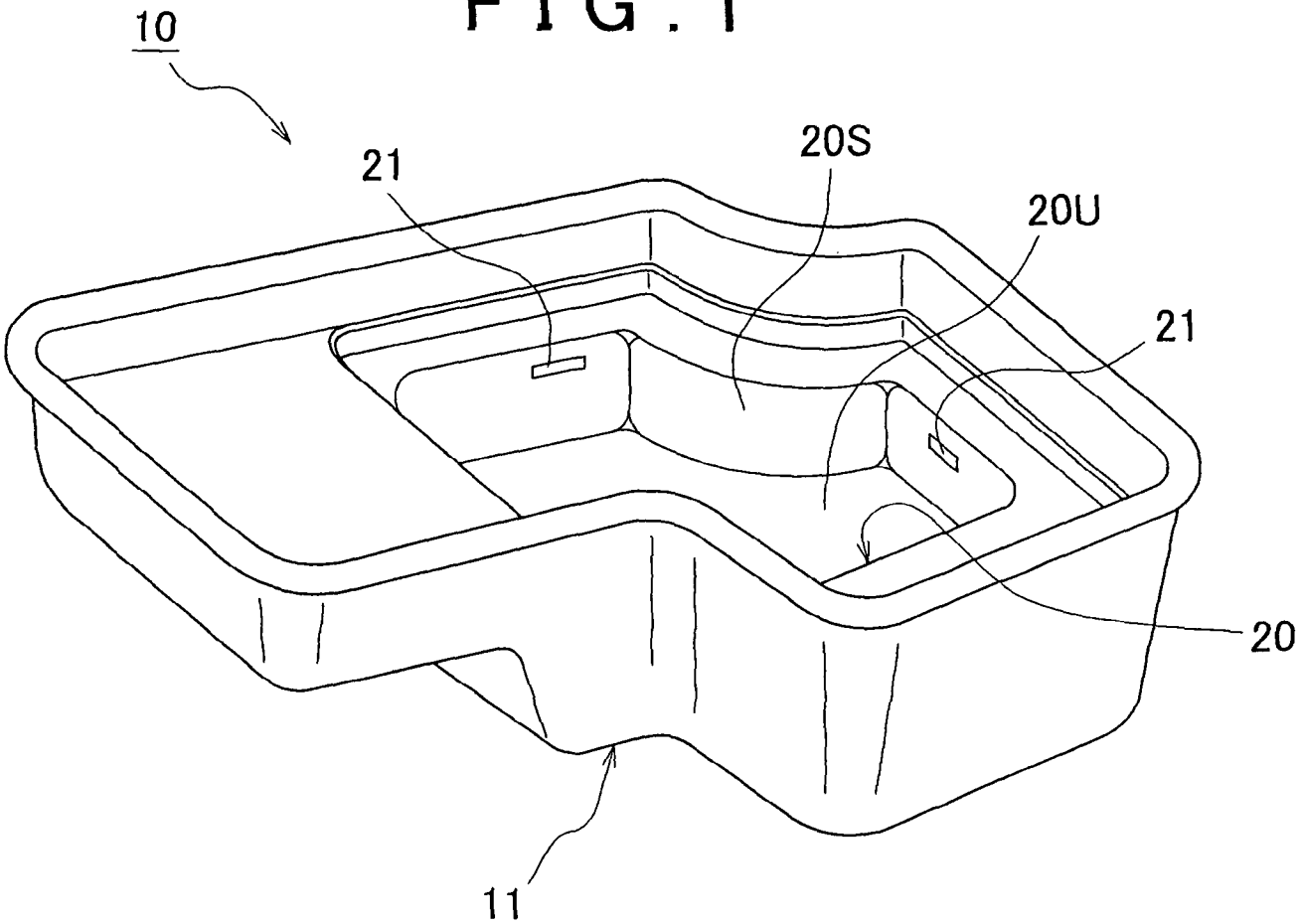
FIG. 1 is a perspective view of an oil pan.

Hereinafter, an embodiment of the invention will be described with reference to FIG. 1 to FIG. 7. A double-tank oil pan 10 (hereinafter, simply referred to as "oil pan 10") shown in FIG. 1 is assembled to the lower portion of an engine (not shown) of a vehicle and is able to store a predetermined amount of oil. The oil pan 10 is formed so that an inner tank 20 is assembled to the inside of an outer tank 11. In addition, a balance shaft, a crank cap, an oil baffle plate, an oil strainer, and the like (not shown), are arranged inside the oil pan 10 (inner tank 20).

Figure 2:
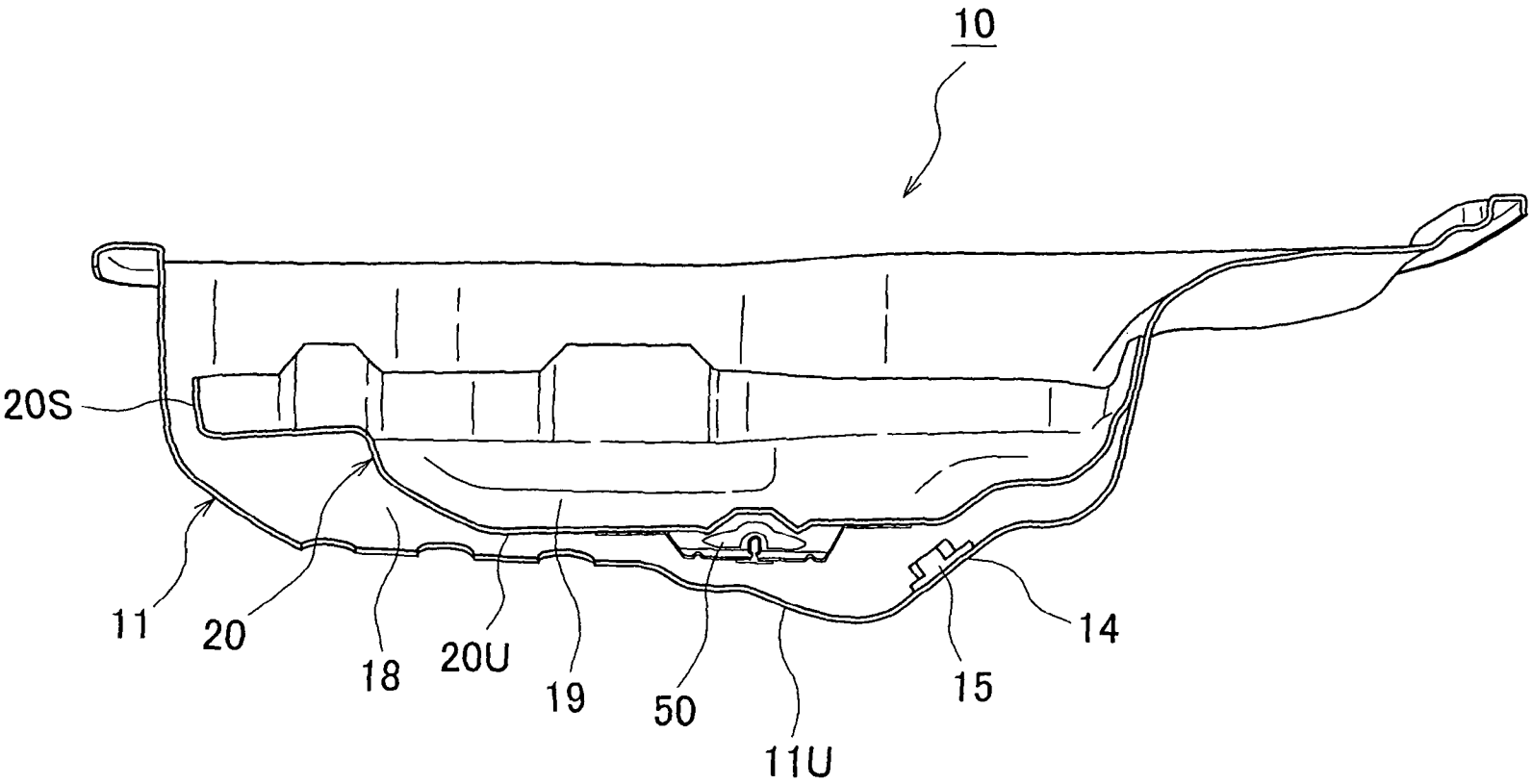
FIG. 2 is a cross-sectional view of the oil pan.
Figure 3:
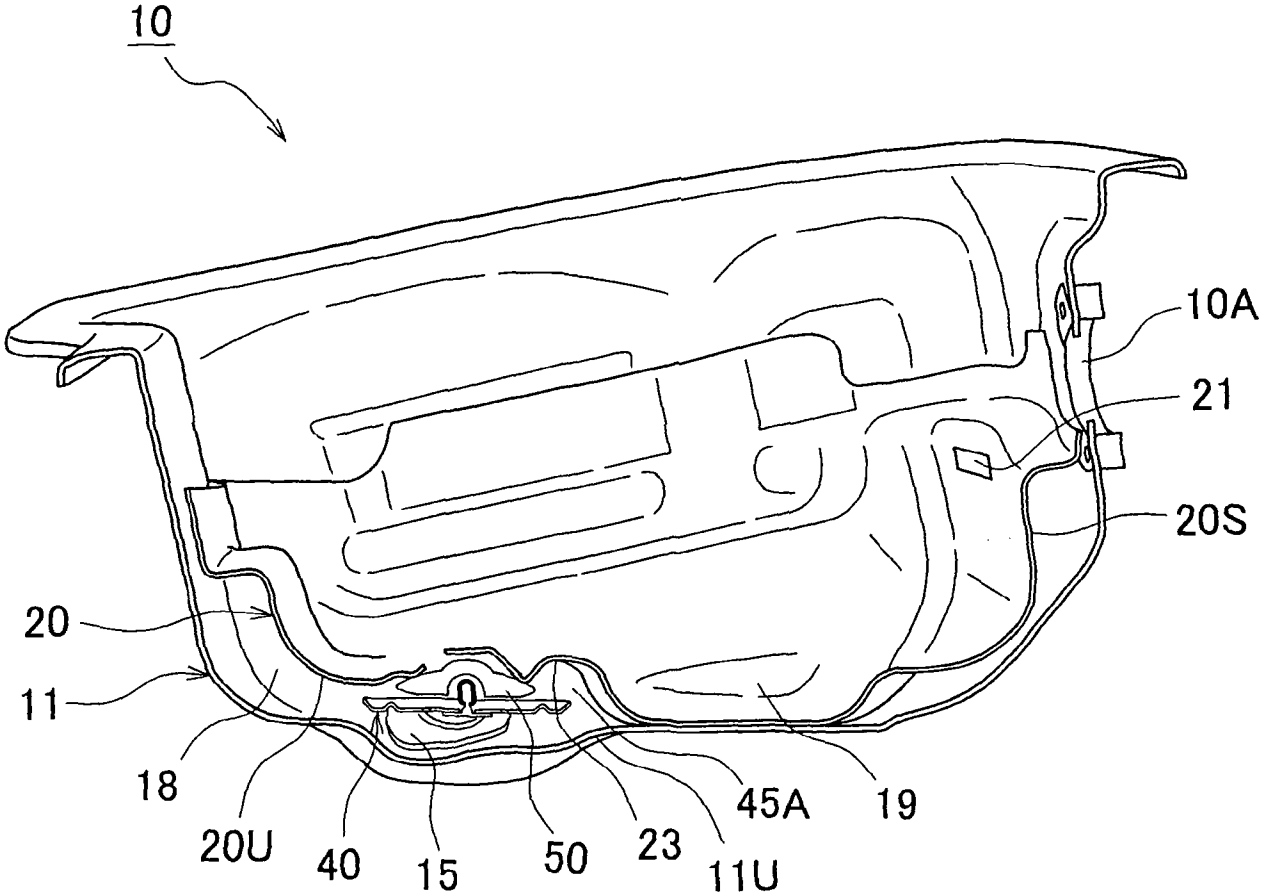
FIG. 3 is a cross-sectional view of the oil pan.

The outer tank 11 has an upward open vessel shape. As shown in FIG. 2, a drain hole 14 is formed in the bottom wall 11U of the outer tank 11 at a position that is lowest when the oil pan 10 is assembled to the engine, or a position near the lowest position. A drain bolt 15 is inserted from the outer side of the outer tank 11 into the drain hole 14. When the drain bolt 15 is removed from the drain hole 14, oil inside the oil pan 10 may be drained outside under its own weight.

The inner tank 20 has a vessel shape corresponding to the inner surface shape of the outer tank 11 and is open upward. The inner tank 20 has a step at the middle portion of the side wall 20S thereof. The step projects laterally. The peripheral portion of the inner tank 20 adjacent to the open end with respect to the step is overlappingly welded to the side wall inner surface of the outer tank 11. The baffle plate (not shown) is overlaid from the upper side of the inner tank 20, and the baffle plate, the inner tank 20 and the outer tank 11 are integrally fixed to one another.

The oil strainer arranged inside the inner tank 20 extends from an oil pump (not shown). Oil stored in the inner tank 20 is pumped by the oil pump, and is supplied to the engine located above the oil pan 10 through the oil strainer. Then, oil that has lubricated and cooled various portions of the engine flows downward to the inner tank 20 of the oil pan 10 under its own weight.

The inside of the oil pan 10 is partitioned into an outer storage chamber 18 and an inner storage chamber 19. The outer storage chamber 18 is sandwiched by the inner tank 20 and the outer tank 11. The inner storage chamber 19 is located inside the inner tank 20. The bottom and side of the inner storage chamber 19 are surrounded by the outer storage chamber 18.

A plurality of horizontally oblong holes 21 (see FIG. 1) are formed through the side wall 20S of the inner tank 20. The plurality of horizontally oblong holes 21 provide fluid communication between the inside and outside of the inner tank 20 (between the outer storage chamber 18 and the inner storage chamber 19). These horizontally oblong holes 21 are formed so as to adequately exchange oil between the inner storage chamber 19 and the outer storage chamber 18. More specifically, in a state where the temperature of oil is relatively low and the viscosity of oil is high, flow of oil from the outer storage chamber 18 to the inner storage chamber 19 is suppressed; whereas, when oil is warmed up and the viscosity of oil decreases, oil easily flows from the outer storage chamber 18 to the inner storage chamber 19. By so doing, immediately after engine start, flow of oil from the outer storage chamber 18 to the inner storage chamber 19 is suppressed to facilitate an increase in the temperature of oil inside the inner storage chamber 19. In addition, after oil is warmed up to some extent, it is possible to prevent excessive high temperature of oil inside the inner storage chamber 19 owing to oil flowing from the outer storage chamber 18.

When oil inside the oil pan 10 is drained through the drain hole 14, oil inside the inner storage chamber 19 needs to be drained via the outer storage chamber 18. Therefore, the bottom wall 20U of the inner tank 20 has valve ports 34 that provide fluid communication between the outer storage chamber 18 and the inner storage chamber 19.

Here, when the valve ports 34 are constantly open, oil in the outer storage chamber 18 is drawn through the valve ports 34 when oil is pumped by the oil pump, and the rate of increase in the temperature of oil decreases. Then, a float valve 50 is arranged below the valve ports 34. The float valve 50 is used to close the valve ports 34 constantly in a state where a prescribed amount of oil is stored in the oil pan 10.

Hereinafter, an oil pan inner tank valve structure according to the present embodiment will be described in detail. A circular hole 23 is formed in the bottom wall 20U at a position near the drain hole 14. The circular hole 23 extends through the bottom wall 20U. An upper cover 30 is attached from the inner side of the inner tank 20 to the circular hole 23, and a lower cover 40 is attached from the outer side of the inner tank 20 so as to face the circular hole 23.

The upper cover 30 is, for example, formed by pressing sheet metal. More specifically, a conical recess 31 that is concentric with the circular hole 23 is formed at the center portion of the upper cover 30, a bank-shaped valve seat 33 that extends along the outer periphery of the conical recess 31 is formed around the conical recess 31, and, furthermore, the outer side of the valve seat 33 serves as a plate-like flange portion 32.

The conical recess 31 is formed so that the center portion of the upper cover 30 is bulged in a truncated cone shape toward the inner side (upper side) of the inner tank 20. The valve seat 33 is continuous with the conical recess 31 and has an annular shape that bulges toward the outer tank 11 (lower side), and the top portion of the valve seat 33 has a smooth curved surface over all round. Then, the upper cover 30 is fixed (for example, riveted) in a state where the valve seat 33 is protruded downward from the circular hole 23 and the flange portion 32 is overlaid on the inner surface of the bottom wall 20U. Here, when the oil pan 10 is assembled to the engine, a portion of the bottom wall 20U at which the circular hole 23 is formed is inclined with respect to the horizontal plane (see FIG. 3), and the bulged amount of the valve seat 33 from the flange portion 32 gradually varies in the circumferential direction so that, when the upper cover 30 is fixed to the bottom wall 20U, the top portion of the valve seat 33 is arranged along the same horizontal plane (see FIG. 7).

Figure 7:
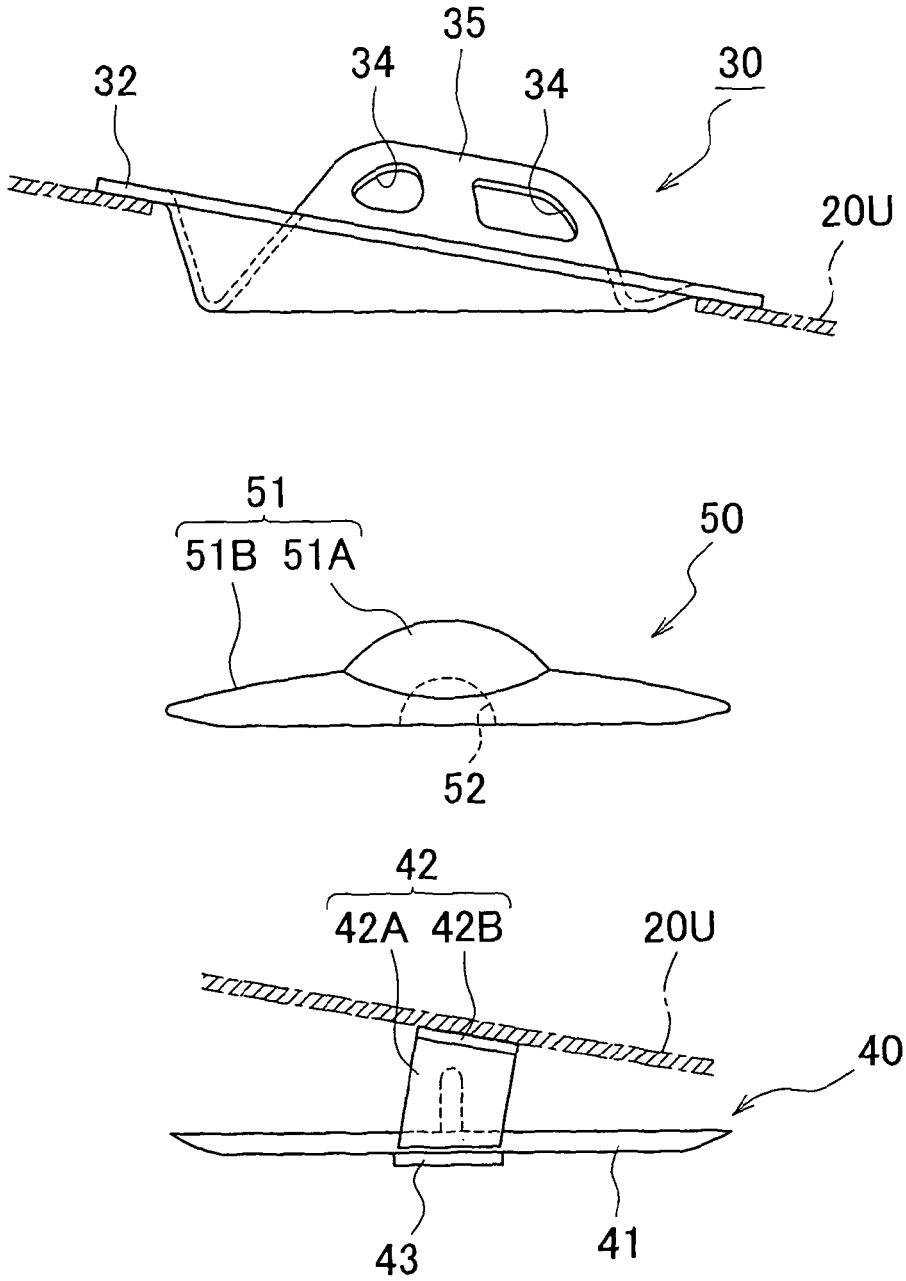
FIG. 7 is a side view of an upper cover, float valve and lower cover.

The plurality of (for example, four) valve ports 34 are formed at the center of the conical recess 31 of the upper cover 30. Each valve port 34 is defined by a top wall 35 that intersects in the shape of a cross at the center portion of the conical recess 31. Note that FIG. 7 shows only two of the four valve ports 34.

Figure 8:
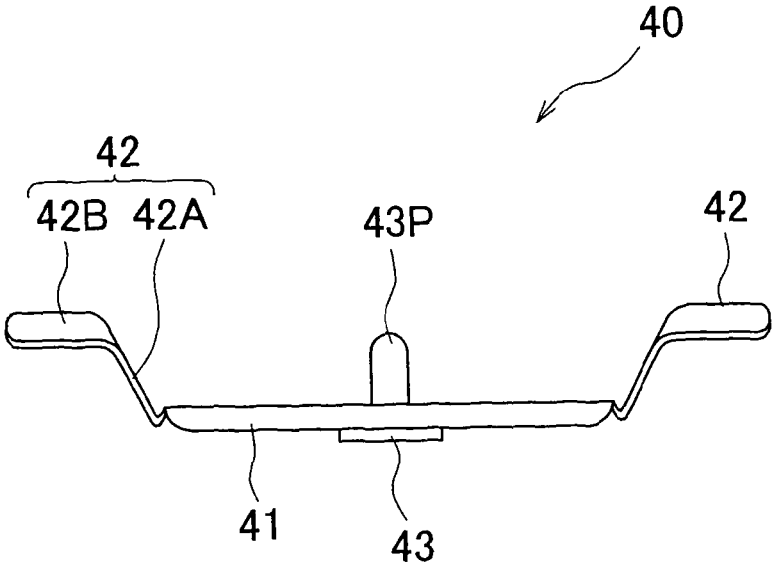
FIG. 8 is a side view of the lower cover.

As shown in FIG. 8, the lower cover 40 is formed of a base plate 41 and a pair of leg portions 42. The base plate 41 has a circular thin dish shape, and is arranged to face the area inside the valve seat 33 (the conical recess 31 and the valve ports 34) of the upper cover 30. In addition, a lateral movement restricting pin 43P (which corresponds to a "lateral movement restricting portion" according to the aspect of the invention) is upright from the upper surface center portion of the base plate 41. More specifically, the lateral movement restricting pin 43P is formed so that a tack 43 extends through the center portion of the base plate 41 from the lower side, the head of the tack 43 is welded to the lower surface of the base plate 41 and a cap 43C covers a tack shaft that protrudes from the upper surface of the base plate 41. Note that a plurality of punched holes 41A are formed through the base plate 41, and, by so doing, oil does not remain on the base plate 41 when oil is drained from the oil pan 10.

The pair of leg portions 42 respectively project in opposite directions from the outer peripheral edge of the base plate 41 at positions that are located 180 degrees away from each other. More specifically, each leg portion 42 has an upright piece 42A and a projecting piece 42B. The upright piece 42A is bent upright from the outer peripheral edge of the base plate 41 toward the bottom wall 20U of the inner tank 20 (upward). The projecting piece 42B is bent laterally of the base plate 41 from the distal end of the upright piece 42A. The lower cover 40 is fixed (for example, riveted) so that the projecting pieces 42B are overlaid on the outer surface of the bottom wall 20U in a state where the base plate 41 is arranged to face the valve seat 33 and the conical recess 31 below the valve seat 33 and the conical recess 31. Here, when the oil pan 10 is assembled to the engine, the portion of the bottom wall 20U at which the circular hole 23 is formed is inclined with respect to the horizontal plane, and the pair of leg portions 42 are inclined with respect to the base plate 41 so that the base plate 41 is horizontal when the lower cover 40 is fixed to the bottom wall 20U (see FIG. 7).

The float valve 50 is accommodated in a valve accommodating room 45 formed between the bottom wall 20U of the inner tank 20 and the lower cover 40, and is movable only within the valve accommodating room 45. The float valve 50 is formed of a material having a specific gravity lower than that of oil (for example, foamed phenolic resin, foamed nylon resin, or the like). The float valve 50 has a vertically oblate disc shape. The float valve 50 has an upper surface mound portion 51 on its upper surface. The upper surface mound portion 51 gradually bulges upward from the outer peripheral portion toward the center portion. The upper surface mound portion 51 is an upper portion with respect to the middle portion in the vertical direction. The upper surface mound portion 51 has a center protruding portion 51A and a hillside portion 51B. The center protruding portion 51A protrudes upward so that the gradient is steeper than that of the lower portion. The hillside portion 51B is the lower portion with respect to the middle portion, and the surface of the hillside portion 51B has a spherical shape.

On the other hand, the lower surface of the float valve 50 is formed so that the portion adjacent to the outer peripheral edge is a tapered surface and the center portion is a flat surface. The float valve 50 has a center recess 52 at its lower surface center portion. The center recess 52 is depressed in a dome shape toward the center protruding portion 51A.

Figure 4:
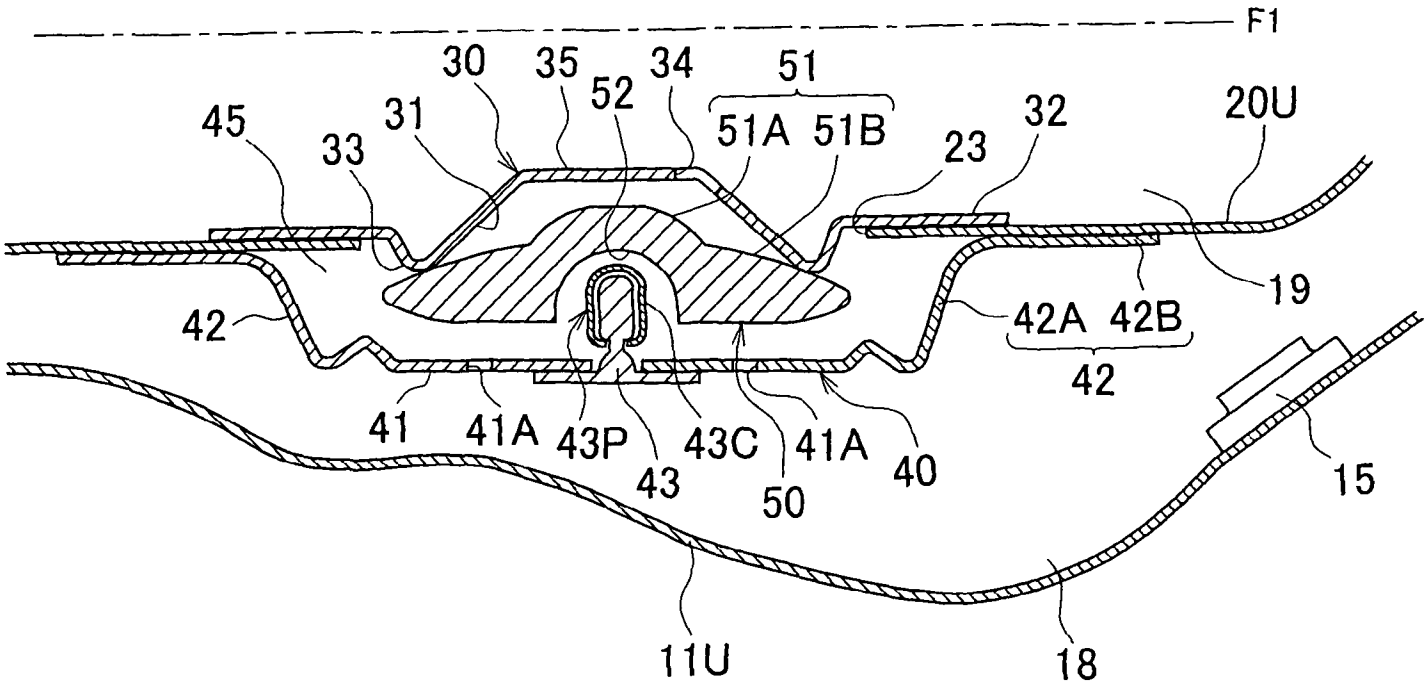
FIG. 4 is an enlarged cross-sectional view of an oil pan inner tank valve structure in a valve closed state.
Figure 5:
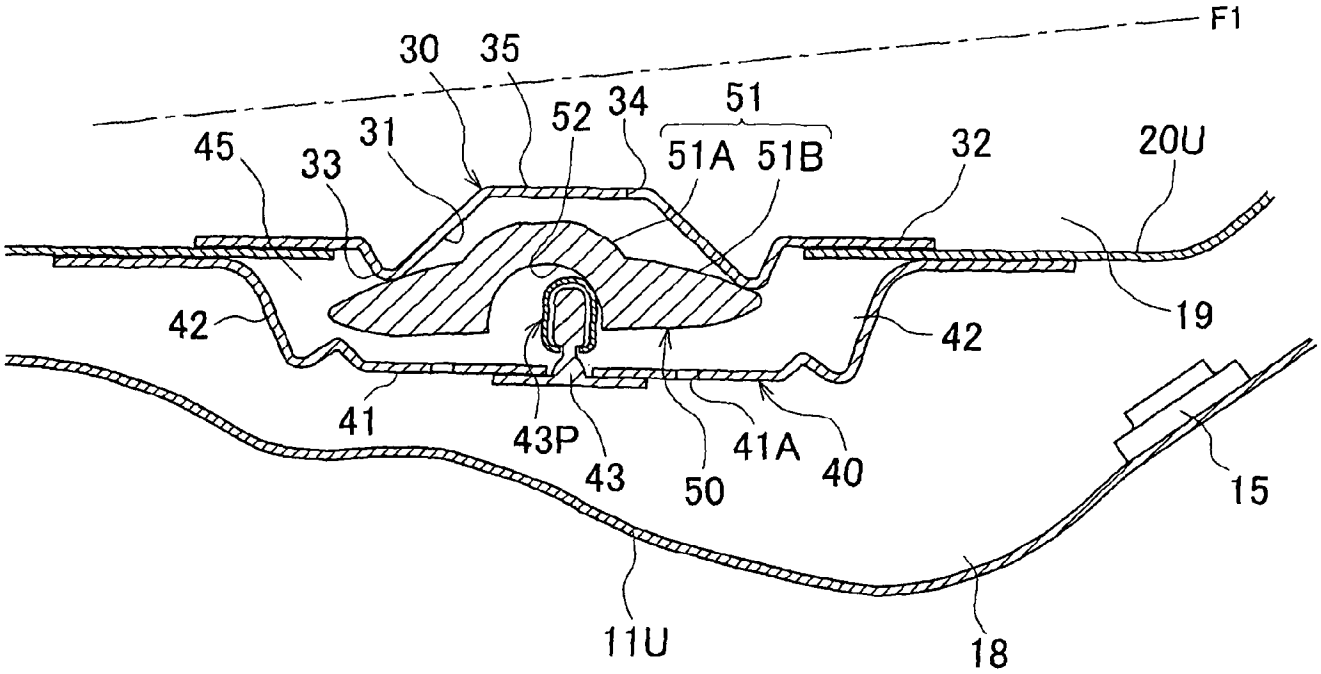
FIG. 5 is an enlarged cross-sectional view of the oil pan inner tank valve structure in a state where a float valve is inclined.
Figure 6:
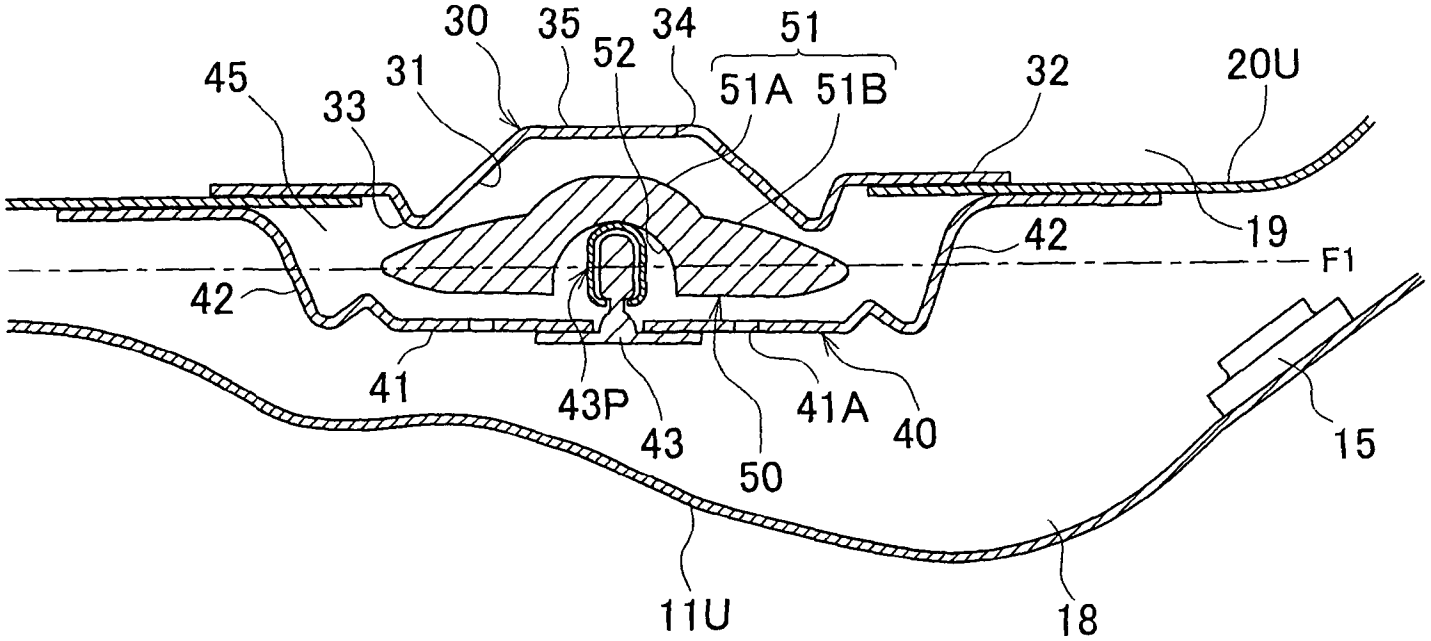
FIG. 6 is an enlarged cross-sectional view of the oil pan inner tank valve structure in a valve open state.

As shown in FIG. 4, the base plate 41 of the lower cover 40 is arranged to face the lower surface of the float valve 50 to thereby restrict the vertically movable range of the float valve 50. In addition, as shown in the drawing, because the center recess 52 is engaged with the lateral movement restricting pin 43P by recess/protrusion engagement, the laterally movable range of the float valve 50 is restricted so that the top portion of the float valve 50 constantly faces the area inside the valve seat 33 (valve ports 34) in the vertical direction. Here, the center recess 52 is loosely fitted to the lateral movement restricting pin 43P, inclination and lateral movement of the float valve 50 with respect to the valve seat 33 are allowed within the range of the gap (play).

In addition, the center protruding portion 51A that protrudes in the same direction as the direction in which the center recess 52 is depressed is provided at the center of the upper surface mound portion 51 to thereby make it possible to balance the thickness of the float valve 50, so, when the float valve 50 is molded by resin, molding sink is reduced to thereby make it possible to stabilize the surface shape of the upper surface mound portion 51.

Note that the material of the float valve 50 may be the one that has excellent heat resistance and oil resistance and has a specific gravity lower than that of oil, and is not limited to the above described foamed phenolic resin or foamed nylon resin.

The lower cover 40 corresponds to the "vertical movement restricting portion" and the "bulged wall" according to the aspect of the invention. In addition, a lateral open space 45A (see FIG. 3) of the valve accommodating room 45, which is formed between the lower cover 40 and the bottom wall 20U of the inner tank 20, and the punched holes 41A formed in the base plate 41 correspond to the "oil passing hole" according to the aspect of the invention.

The configuration of the present embodiment is described above. Next, the operation of the present embodiment will be described. When a prescribed amount of oil is stored in the oil pan 10, the float valve 50 receives buoyancy in a state where the float valve 50 is submerged below an oil surface F1. At this time, the hillside portion 51B of the upper surface mound portion 51 of the float valve 50 is pressed against the valve seat 33 by the buoyancy of oil, and is in line contact with the valve seat 33 all around the valve seat 33 (see FIG. 4). By so doing, the valve ports 34 are closed, and flow of oil via the valve ports 34 between the inner storage chamber 19 and the outer storage chamber 18 is prohibited.

In addition, for example, when the vehicle is inclined longitudinally or transversely, the float valve 50 is inclined with respect to the valve seat 33 within the range of the gap (play) between the lateral movement restricting pin 43P and the center recess 52. In such a case as well, the float valve 50 has the upper surface mound portion 51 on its upper surface, so the valve closed state may be maintained. More specifically, the hillside portion 51B of the upper surface mound portion 51 has a spherical shape, so, even when the float valve 50 is inclined in any one of directions inside the valve accommodating room 45, the hillside portion 51B of the upper surface mound portion 51 may be brought into line contact with the valve seat 33 all around the valve seat 33, so the valve closed state is stable (see FIG. 5).

Oil that is pumped by the oil pump and that has lubricated and cooled various portions of the engine flows downward to the lower side of the engine, and is then returned to the inner tank 20 (inner storage chamber 19) of the oil pan 10. Here, the float valve 50 has a vertically oblate disc shape, so the float valve 50 is hard to be exposed from the oil surface in the inner tank 20. Therefore, oil flowing downward from the engine is prevented from hitting the float valve 50. This prevents the valve ports 34 from abnormally opening because of oil. In addition, even if the valve ports 34 are exposed from the oil surface F1 because of inclination of the oil surface F1 due to a change of the attitude of the vehicle or oil shortage, the float valve 50 is covered from the upper side with the top wall 35 provided for the upper cover 30, so oil flowing downward from the engine is hard to hit the float valve 50, and it is possible to suppress abnormal valve opening.

When the drain hole 14 of the outer tank 11 is opened (the drain bolt 15 is removed) in order to drain oil from the oil pan 10, first, oil in the outer storage chamber 18 flows out through the drain hole 14 under its own weight. With a decrease in the level of the oil surface of the outer storage chamber 18, the float valve 50 is lowered and is separated from the valve seat 33. As a result, the valve ports 34 are opened, and oil flows out from the inner storage chamber 19 to the outer storage chamber 18 via the valve ports 34 under its own weight (see FIG. 6). During then, the lateral movement restricting pin 43P and the center recess 52 maintain their recess/protrusion engagement, so lateral movement of the float valve 50 is restricted. That is, the float valve 50 is lowered in a state where the top portion (center protruding portion 51A) of the upper surface mound portion 51 faces the area inside the valve seat 33 (valve ports 34) from the lower side within the valve accommodating room 45. Then, when almost the entire amount of oil in the inner storage chamber 19 and the outer storage chamber 18 has flown out and no buoyancy is exerted on the float valve 50 from oil, the float valve 50 remains on the base plate 41 while the float valve 50 is engaged with the lateral movement restricting pin 43P by recess/protrusion engagement.

In a state where the oil pan 10 is empty, when oil is poured to an oil hole (not shown) at the upper portion of the engine, the poured oil flows into the inner tank 20 (inner storage chamber 19) from an inlet port 10A (see FIG. 3) formed in the side surface of the oil pan 10, and further flows into the outer storage chamber 18 through the valve ports 34 in the valve open state. Then, the float valve 50 is raised with a rise in the oil surface in the outer storage chamber 18, and finally contacts the valve seat 33 to close the valve ports 34. During then, the lateral movement restricting pin 43P and the center recess 52 maintain recess/protrusion engagement, so lateral movement of the float valve 50 is restricted. That is, the float valve 50 is raised in a state where the center protruding portion 51A faces the area inside the valve seat 33 from the lower side within the valve accommodating room 45. In addition, bubbles are held in the center recess 52 of the float valve 50, so it is possible to raise the float valve 50 by the bubbles and the buoyancy of oil.

In this way, according to the present embodiment, the lower cover 40 (base plate 41) provided on the lower surface of the bottom wall 20U of the inner tank 20 restricts the vertically movable range of the float valve 50, and the lateral movement restricting pin 43P that is upright from the lower cover 40 (base plate 41) restricts the laterally movable range of the float valve 50. Then, the float valve 50 is formed in a disc shape so as to function as a valve element and a floating element to thereby make it possible to reduce the size in the vertical direction as compared with the existing art. In addition, the float valve 50 is arranged at a position lower than that of the existing art to make it possible to suppress the influence of the inclination of the oil surface or flow of inner tank oil, so it is possible to prevent abnormal valve opening of the float valve 50. Furthermore, the upper surface mound portion 51 is formed on the upper surface of the float valve 50, so the valve ports 34 may be closed irrespective of the inclination of the float valve 50. Moreover, the hillside portion 51B of the upper surface mound portion 51 has a spherical shape, so the valve closed state is further stable.

In addition, because the valve seat 33 may be formed by pressing, time and effort for machining may be reduced in comparison with the case where the opening edge of a valve port formed through the bottom wall 20U of the inner tank 20 is chamfered to form a valve seat. In addition, because the valve seat 33 is formed of a smooth curved surface, it is possible to prevent the valve seat 33 and the float valve 50 from being caught by each other.

Here, the size of the existing float valve is large in the vertical direction, so the float valve is easily exposed from an oil surface, and return oil flowing from the engine toward the inner tank 20 easily collides with the float valve. Therefore, abnormal valve opening easily occurs or air content in oil easily increases because of an impact of return oil. In addition, the existing float valve interferes with an oil baffle plate, an oil strainer, and the like, arranged inside the inner tank 20, so a valve port cannot be arranged below the oil strainer, and the like.

In contrast to this, the size of the float valve 50 according to the present embodiment may be reduced in the vertical direction, so the float valve 50 is hard to be exposed from the oil surface F1. Therefore, this prevents return oil flowing from the engine from directly hitting the float valve 50, so it is possible to suppress abnormal valve opening or an increase in air content due to return oil. In addition, there is no problem of interference with the oil strainer, and the like, and the flexibility of arrangement of the valve ports 34 increases. Furthermore, in comparison with the case where the existing float valve in which the floating element and the valve shaft are arranged inside the inner tank is used, it is possible to increase the amount of oil stored in the inner tank 20. Moreover, the float valve 50 is brought into line contact with the valve seat 33 to increase the seal contact pressure with the valve seat 33, and the float valve 50 may be easily separated from the valve seat 33 when oil is drained from the oil pan 10.

Second Embodiment

Figure 9:
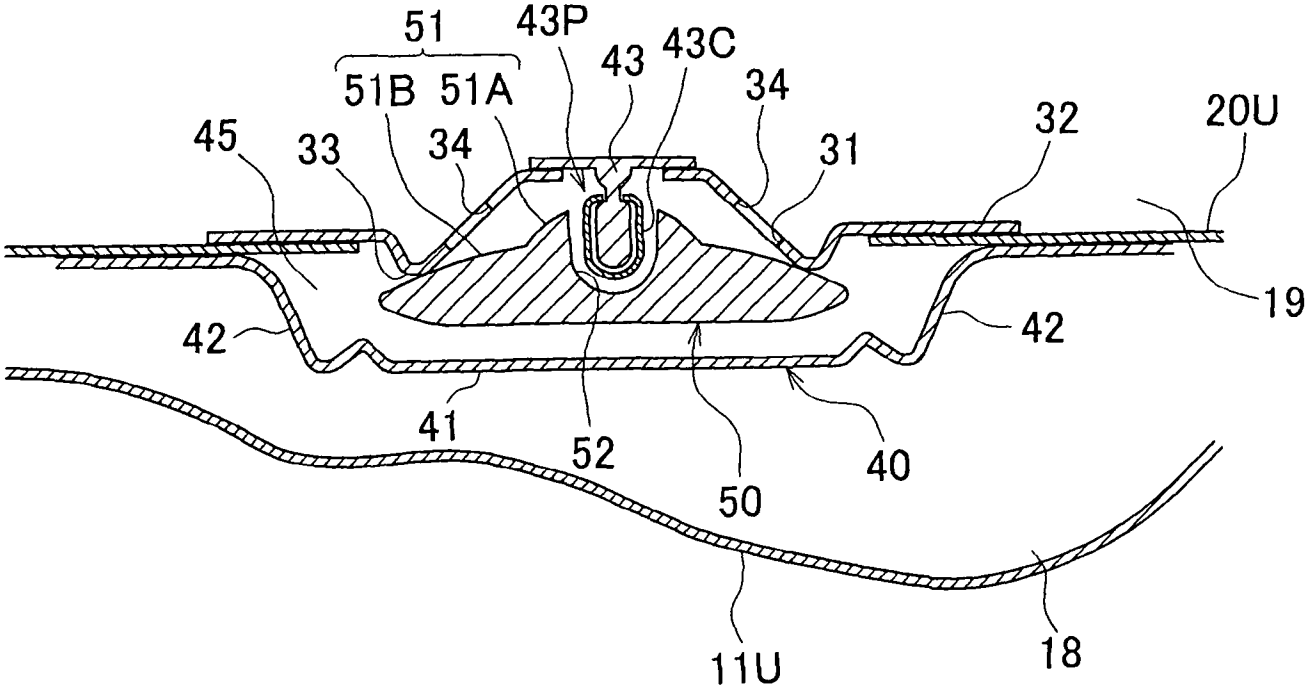
FIG. 9 is a side cross-sectional view of an oil pan inner tank valve structure according to a second embodiment of the invention.

FIG. 9 shows a second embodiment of the invention in which arrangement of the lateral movement restricting pin 43P and the center recess 52 is varied from that of the first embodiment. As shown in the drawing, the lateral movement restricting pin 43P protrudes downward through the center of the conical recess 31 of the upper cover 30. On the other hand, the center recess 52 is depressed at the center portion of the upper surface mound portion 51 of the float valve 50. Then, these lateral movement restricting pin 43P and the center recess 52 are constantly engaged with each other by recess/protrusion engagement in the vertical direction. The other configuration is the same as that of the first embodiment, so the overlap description is omitted. With the configuration of the present embodiment as well, advantageous effects equivalent to those of the first embodiment are obtained.

Note that the lower surface center of the float valve 50 may be bulged in a direction in which the center recess 52 is depressed to balance the thickness of the float valve 50.

Alternative Embodiments

The aspect of the invention is not limited to the above embodiments. The technical scope of the invention, for example, encompasses embodiments described as follows, and may be carried out in various forms, other than the following embodiments, without departing from the scope of the invention.

(1) In the above embodiments, the plurality of valve ports 34 are provided in the area inside the valve seat 33; instead, for example, only one valve port that is concentric with the valve seat 33 may be provided.

(2) In the above embodiments, lateral movement of the float valve 50 is restricted by the center recess 52 formed by depressing the float valve 50 and the lateral movement restricting pin 43P received by the center recess 52; instead, for example, lateral movement of the float valve 50 may be restricted by a surrounding wall or fence that laterally surrounds the float valve 50.

(3) In the above embodiments, the lower cover 40 is formed so that the pair of leg portions 42 protrude from the base plate 41; instead, the lower cover may have a vessel structure that bulges downward from a position surrounding the valve seat 33 and may have an oil passing hole formed therethrough.

(4) In the above embodiments, the valve seat 33, the conical recess 31 and the valve ports 34 are formed in the upper cover 30 that is separated from the inner tank 20; instead, these valve seat, circular recess and valve ports may be integrally formed with the bottom wall 20U of the inner tank 20.

(5) In the above embodiments, the tack 43 is fixed to the lower cover 40 to provide the lateral movement restricting pin 43P; instead, the lateral movement restricting pin 43P may be integrally formed with the lower cover 40.

Figure 10:
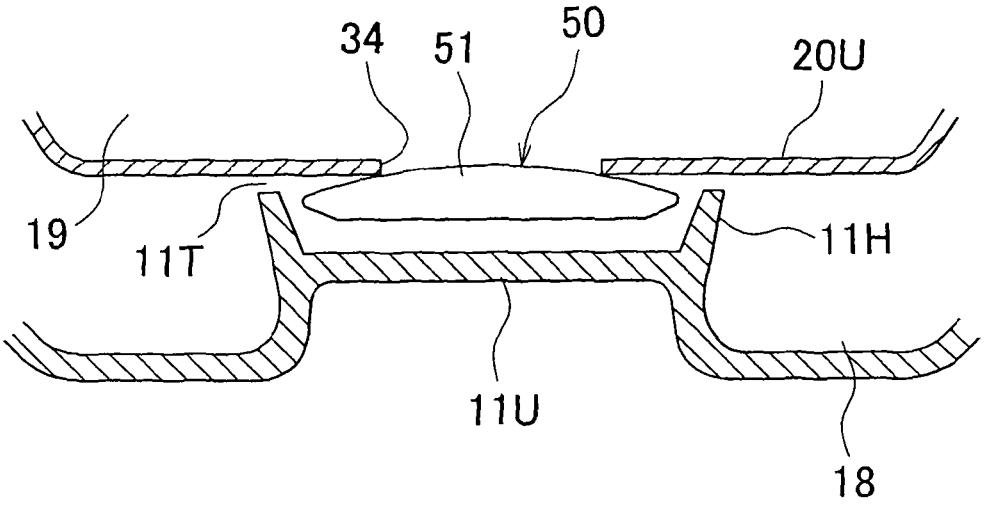
FIG. 10 is a side cross-sectional view of an oil pan inner tank valve structure according to an alternative embodiment.

(6) In the above embodiments, the lower cover 40 fixed to the bottom wall 20U of the inner tank 20 constitutes the "vertical movement restricting portion" according to the aspect of the invention; instead, it is also applicable that, as shown in FIG. 10, part of the bottom wall 11U of the outer tank 11 is bulged toward the bottom wall 20U of the inner tank 20 to be arranged near the valve port 34 below the valve port 34 and then vertical movement of the float valve 50 is restricted between the bottom wall 20U of the inner tank 20 and the bottom wall 11U of the outer tank 11. In addition, the lateral movement restricting pin 43P that is loosely fitted to the center recess 52 of the float valve 50 may be upright from the bulged portion of the bottom wall 11U, and, as shown in FIG. 10, a surrounding wall 11H that surrounds the float valve 50 and that has an oil passing hole 11T may be upright from the bulged portion of the bottom wall 11U to restrict lateral movement of the float valve 50.

Figure 11:
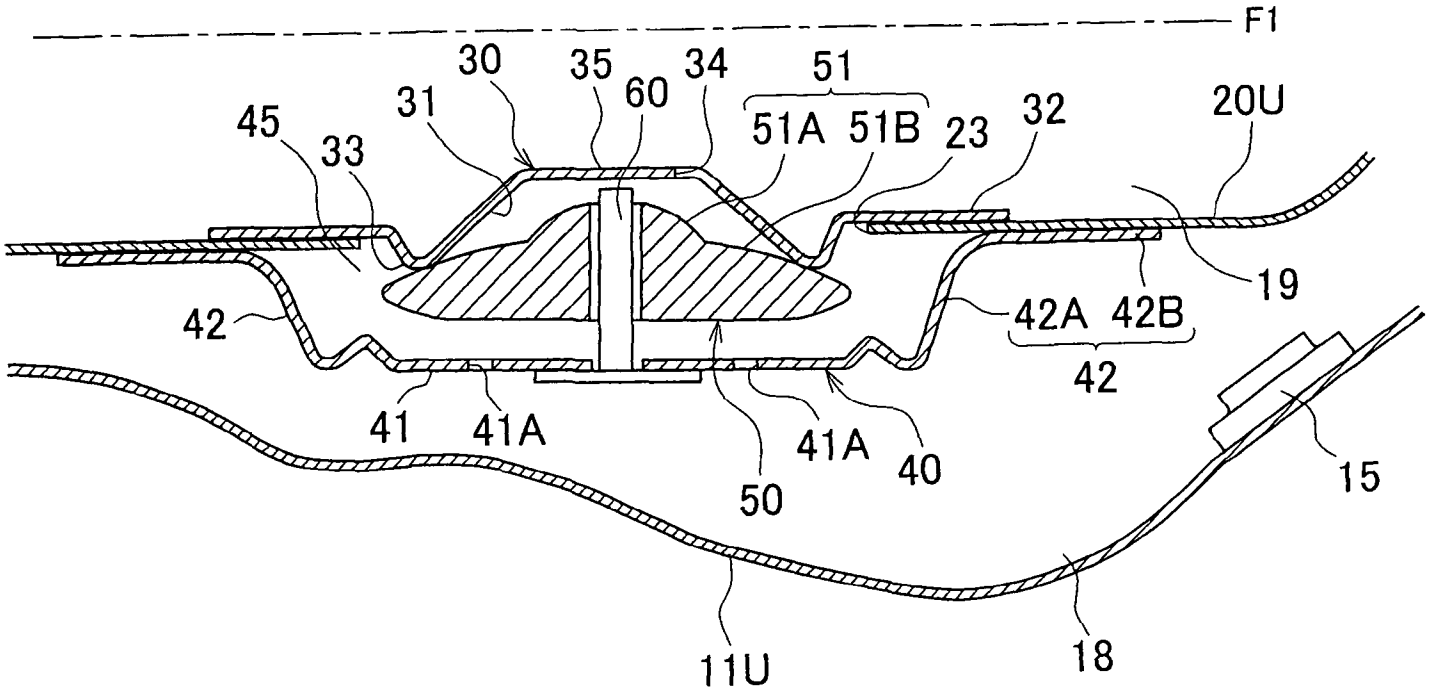
FIG. 11 is a side cross-sectional view of an oil pan inner tank valve structure according to an alternative embodiment.

(7) As shown in FIG. 11, it may be configured so that a shaft 60 that extends between the center portion of the base plate 41 of the lower cover 40 and the center portion of the conical recess 31 of the upper cover 30 extends through the center portion of the float valve 50 in a loose fit manner.

(8) In the above embodiments, the hillside portion 51B of the float valve 50 is brought into line contact with the valve seat 33; instead, the hillside portion 51B may be brought into plane contact with the valve seat 33.

(9) It is also applicable that an inlet of the oil strainer is arranged near the valve ports 34 and then the float valve 50 is raised by the buoyancy of oil and the suction force of the oil pump.

(10) In the above embodiments, the float valve 50 has a disc shape; however, the float valve 50 may have a semi-spherical shape or conical shape as a whole.

(11) In addition, in the float valve 50 according to the above embodiments, the hillside portion 51B has a spherical surface; instead, the hillside portion 51B may have a conical surface.

(12) In the above embodiments, the valve seat 33 is formed by pressing; however the valve seat 33 may be formed by chamfering the opening edge of the valve port formed through the bottom wall 20U of the inner tank 20. Further, the forming method of the valve seat 33 may be determined based on the material of the inner tank 20.

The invention claimed is:

1. An oil pan inner tank valve structure in a double-tank oil pan having an inner tank inside an outer tank, comprising:

a valve port that is formed in a bottom wall of the inner tank;

a float valve that is arranged below the valve port, that contacts or moves away from a valve seat around the valve port depending on whether there is buoyancy of oil inside the double-tank oil pan to open or close the valve port, that has an upper surface mound portion gradually bulging or protruding upward from an outer peripheral portion of an upper surface of the float valve, and that closes the valve port in such a manner that the upper surface mound portion contacts the valve seat, the upper surface mound portion of the float valve having a center protruding portion and a contact portion that contacts the valve seat, the center protruding portion protruding upward at an upper surface center thereof at an inclination steeper than that of the contact portion;

a vertical movement restricting portion that faces a lower surface of the float valve and that restricts a vertically movable range of the float valve; and a lateral movement restricting portion that is provided on any one of the inner tank and the outer tank, and that restricts lateral movement of the float valve so that a top portion of the upper surface mound portion constantly vertically faces an area inside the valve seat, wherein one of a lower surface center and upper surface center of the float valve has a center recess formed in a surface thereof, the lateral movement restricting portion is a lateral movement restricting pin that is received by the center recess and that extends beyond the float valve in a direction away from a closed innermost end of the center recess, the center recess being fitted to the lateral movement restricting pin with a gap disposed therebetween such that inclination and lateral movement of the float valve relative to the valve seat are allowed within a range of the gap, the lateral movement restricting pin is constantly disposed within the center recess, the lateral movement restricting portion having a cover portion covering a top surface, a first side surface, a second side surface, and a portion of a bottom surface of the lateral movement restricting pin, the vertical movement restricting portion is a bulged wall that bulges downward from a lateral position with respect to the valve seat on a lower surface of the bottom wall of the inner tank and that has an oil passing hole that allows the oil to pass therethrough, and the float valve is accommodated in a valve accommodating room between the bottom wall and the bulged wall.

2. The oil pan inner tank valve structure according to claim 1, wherein the contact portion contacts the valve seat, and at least a surface of the contact portion has a spherical shape.

3. The oil pan inner tank valve structure according to claim 1, wherein the valve seat is formed so that an annular area of the bottom wall, surrounding the valve port, is bulged downward.

4. The oil pan inner tank valve structure according to claim 1, wherein a plurality of the valve ports are provided inside the valve seat.

5. The oil pan inner tank valve structure according to claim 1, wherein the center protruding portion protrudes in a direction in which the center recess is depressed.

6. The oil pan inner tank valve structure according to claim 1, wherein the vertical movement restricting portion covers the center recess from a lower side, and the lateral movement restricting pin protrudes from the vertical movement restricting portion.

7. The oil pan inner tank valve structure according to claim 1, wherein the vertical movement restricting portion is a lower cover that is arranged below the inner tank, the lower cover has a base plate that is arranged to face the area inside the valve seat and that has a circular thin dish shape and a plurality of leg portions that extend from the base plate to the bottom wall of the inner tank, and the float valve is accommodated in the valve accommodating room between the bottom wall and the lower cover.

8. The oil pan inner tank valve structure according to claim 1, wherein the float valve has a vertically oblate disc shape.

9. The oil pan inner tank valve structure according to claim 1, wherein the center recess and the lateral movement restricting pin overlap each other in every position of the float valve as viewed along a direction parallel to a lateral direction in which the lateral movement of the float valve is restricted by the lateral movement restricting pin.

10. The oil pan inner tank valve structure according to claim 1, wherein the inner tank has a circular hole that extends through the bottom wall and an upper cover that is fitted to the circular hole from an inner side of the inner tank, and the valve port and the valve seat are formed by the upper cover.

11. The oil pan inner tank valve structure according to claim 10, wherein the upper cover has a conical recess at a center portion thereof, the conical recess being bulged in a truncated cone shape concentric with the circular hole toward the inner side of the inner tank, and the valve seat is formed in an annular shape that extends along an outer periphery of the conical recess.

12. A double-tank oil pan comprising the oil pan inner tank valve structure according to claim 1.

13. A vehicle comprising the double-tank oil pan according to claim 12.

* * * * *